United States Patent [19]

von Plessen et al.

[11] 4,145,393

[45] Mar. 20, 1979

[54] PROCESS FOR THE PROTECTION AGAINST CORROSION OF CAST IRON IN BOILING CONCENTRATED SULFURIC ACID

[75] Inventors: Helmold von Plessen, Kelkheim; Edmund Bässler, Schwaikheim, both of Fed. Rep. of Germany

[73] Assignee: Hoechst Aktiengesellschaft, Frankfurt am Main, Fed. Rep. of Germany

[21] Appl. No.: 807,319

[22] Filed: Jun. 16, 1977

[30] Foreign Application Priority Data

Jun. 19, 1976 [DE] Fed. Rep. of Germany ..... 2627536

[51] Int. Cl.[2] ..... C23F 11/04

[52] U.S. Cl. ..... 422/7; 203/7; 203/86; 252/387; 422/8

[58] Field of Search ..... 252/387; 21/2.7 R, 2.5 R; 255/146, 147; 203/7, 86

[56] References Cited

U.S. PATENT DOCUMENTS

| | | | |
|---|---|---|---|
| 2,462,638 | 2/1949 | Hetherington | 252/387 |
| 2,513,131 | 6/1950 | Baer | 252/147 |
| 3,316,179 | 4/1967 | Hoonstra et al. | 252/146 |
| 3,773,675 | 11/1973 | Heiss et al. | 252/147 |
| 3,887,488 | 6/1975 | Scott et al. | 252/147 |

FOREIGN PATENT DOCUMENTS

| | | | |
|---|---|---|---|
| 654999 | 4/1965 | Belgium | 252/387 |
| 53889 | 9/1967 | Poland | 252/387 |

*Primary Examiner*—Herbert B. Guynn

*Attorney, Agent, or Firm*—Curtis, Morris & Safford

[57] ABSTRACT

Gray cast iron can be protected against corrosion in boiling concentrated sulfuric acid if the acid contains precious metals such as gold or the metals of the platinum group. It is possible to add small amounts of compounds of the precious metal to the acid or to bring both the gray cast iron and the acid into contact with metal sheets or wires of the precious metal. It is also possible to use small amounts of the precious metal as an alloying element of the gray cast iron.

4 Claims, No Drawings

PROCESS FOR THE PROTECTION AGAINST CORROSION OF CAST IRON IN BOILING CONCENTRATED SULFURIC ACID

The present invention relates to a process for the protection against corrosion of cast iron in boiling concentrated sulfuric acid.

In some chemical processes a sulfuric acid is obtained as a waste product which may contain, besides water, organic components, mineral salts, hydrochloric acid, nitric acid, and other impurities. A waste acid of this kind having a content of from 70 to 90% of $H_2SO_4$ is frequently regenerated according to the method described by H. Pauling in German Patent Specification No. 299,774 (1915). In this process the waste sulfuric acid is supplied to a stripping column which is mounted upon a boiler of gray cast iron serving as distilling kettle. The boiler fired with gas or mineral oil is filled with boiling concentrated sulfuric acid which is withdrawn and cooled at the same rate as the waste acid is fed in. The water contained in the waste acid leaves the stripping column in the form of water vapor having a temperature of from 130° to 150° C.

The boilers serving as distilling kettles as well as their covers are made of lamellar gray cast iron of pearlitic texture. Investigations into the cast iron have shown graphite structures of A 3 to C 3 according to ASTM in the pearlitic texture, and the composition C 2.9 to 3.5%; Si 1.6 to 1.9%; P 0.2 to 0.6%; S 0.1 to 0.15%; Mn 0.35 to 0.65%; Cr 0.05 to 0.2%; Ni 0.04 to 0.08%; Cu 0.07 to 0.1%; Al<0.03%; the remainder being iron and the impurities which are common for cast iron. Detailed descriptions of the Pauling process have been known from: P. Parrish, Trans. Inst. Chem. Engrs. 19 (1941), 1 - 24 F. Rumford, Chem. Eng. Materials, London 1954, 57 - 75 BIOS Final Report No. 243 FIAT Final Report No. 1187, film K-18.

The corrosion of the boilers made of gray cast iron by boiling concentrated sulfuric acid which occurs in the said process has been examined by E. Maahn (Brit. Corros. J. 1966, vol. 1, page 350).

The corrosion depends on the redox potential of the boiler contents and is intensified by components of sulfuric acid having a reducing effect, for example by organic impurities. In order to avoid this drawback, nitric acid may be admixed to the sulfuric acid. If the process is carried out in a suitable manner, the cast iron in the boiling concentrated sulfuric acid is rendered passive, it is covered with a thin layer of iron-(III) salts, so that the loss due to corrosion is up to 1 cm per year on an average.

However, the application of nitric acid as auxiliary agent in the reprocessing of waste sulfuric acid in Pauling plants may involve difficulties. If the sulfuric acid contains organic substances which can be nitrated, for example aromatic amines, the nitrated compounds being formed are difficult to decompose. Also, nitro compounds of this kind may sometimes represent as operational risk. A part of the added nitric acid can also react with sulfuric acid, while forming nitrosyl-sulfuric acid, which remains as a stable compound in the hot sulfuric acid. Also the elimination of nitrous gases which are formed in the reaction of nitric acid involves a high expenditure from the technical point of view.

A process has now been found for the protection against corrosion of gray cast iron in boiling concentrated sulfuric acid, in which precious metals are added to the sulfuric acid, or are contacted with the cast iron.

Suitable precious metals are gold and the metals of the platinum group. The said precious metals may be used for the above purpose in elementary form as well as in the form of any compound. The cast iron can be protected in a particularly advantageous manner against the corrosion by the boiling concentrated sulfuric acid by a close contact with the above-mentioned elementary precious metals, for example, in the form of wires, sheets or chips. Such a close contact is achieved, for example, by the wrapping with wire or by the fastening of a wire or sheet of the precious metal on the surface of the gray cast iron. The introduction of chips of precious metal into the cast iron during or following the casting process, or an electrolytical depositing of an elementary precious metal on the surface of gray cast iron represent alternative methods for the protection against corrosion according to the invention.

For the same purpose it is also possible to admix compounds of the specified precious metals to the sulfuric acid, for example, the oxides, halides or complex metal acids. The amounts required for this purpose are in the range of from 0.01 to about 50 grams of precious metal per 1000 kg of concentrated sulfuric acid.

The protection against corrosion of the invention is effective in gray cast iron of a pearlitic as well as of a ferritic texture. The graphite portion of the gray cast iron may be present in a lamellar form or as a nodular graphite. Surprisingly, the corrosion-inhibiting effect of the said precious metals is not found in the case of unalloyed carbon-containing steel (steel 1.1740).

The process of the invention for the protection against corrosion of boilers made of gray cast iron appears to be particularly advantageous for the zones near the surface of the boiling concentrated sulfuric acid.

In some Pauling boilers, this zone is exposed to an intensified corrosion (German Patent Specification Nos. 639,225 and 699,770), which results in a groove having a width of up to 10 cm and forming a ring around the boiler.

According to German Offenlegungsschrift No. 2,330,281, impure dilute sulfuric acid is highly concentrated according to the Pauling method in the first step, and subsequently the concentrated sulfuric acid is distilled in the second step. The distillation vessels made of cast iron which are used for this process may be protected according to the invention against the corrosion by the hot concentrated sulfuric acid. It is advantageous that in the process according to German Offenlegungsschrift No. 2,330,281 the added precious metals can be separated again completely and recovered in the second step.

The following Examples serve to illustrate the invention.

EXAMPLES (cf. Table I)

A round flask of a capacity of 1 liter provided with an air-cooled condenser placed on top and a water-cooled condenser arranged above, which was heated by means of an electric heater, was charged with 1 kg of concentrated commercial and analytically pure sulfuric acid of about 96% strength; the gray cast iron or steel samples (for their characterization cf. Table II) were placed or suspended in the same, and the acid was maintained at boiling temperature for 24 hours. In this process the air-cooled condenser and the water-cooled condenser served as reflux condensers (tests 1 through 8). If the water contained in the concentrated sulfuric acid as well as the water formed in the corrosion reaction during the test was to be eliminated continuously, the water-cooled condenser arranged following the air-cooled condenser was designed as a descending condenser (tests 9 through 15). In tests 2, 3, 4 and 13, a gray cast iron sample each was wrapped with platinum or gold wire (diameter of 0.5 mm). If the precious metals were used in the form of compounds, the compound and concentrated sulfuric acid were introduced into the reaction flask, and the corrosion samples were then added. After termination of the heating, the cast iron and steel samples were removed from the flask, rinsed, powerfully rubbed with a cloth, dried and weighed.

TABLE I

| Test No. | Material | Precious metal type | Precious metal form of introduction | Precious metal amount mg | Corrosion samples mode of introduction | Corrosion samples wrapping with wire of precious metal | Corrosion samples sample surface $cm^2$ | Test duration min. | Conc. of $H_2SO_4$ at the beginning of test % |
|---|---|---|---|---|---|---|---|---|---|
| 1 | GG 1 | — | — | — | inserted | — | 17.5 | 1445 | 95.8 |
| | GG 2 | — | — | — | inserted | — | 16.3 | | |
| 2 | GG 2 | Au | wire | 1904.9 | inserted | + | 19.1 | 1470 | 95.8 |
| 3 | GG 2 | Pt | wire | 977.2 | inserted | + | 18.1 | 1445 | about 96 |
| 4 | GG 2 | — | — | — | inserted | — | 17.6 | 1460 | 95.8 |
| | GG 2 | Pt | wire | 978.4 | suspended | + | 18.3 | | |
| 5 | GG 1 | Au | $HAuCl_4 \cdot xH_2O$ | 8.13 | inserted | — | 17.5 | 1450 | 95.8 |
| | GG 2 | | | | inserted | — | 17.5 | | |
| 6 | GG 1 | | $PtO_2 \cdot xH_2O$ | | inserted | — | 17.7 | | |
| | GG 2 | Pt | | 0.87 | inserted | | 17.8 | 1445 | 95.8 |
| 7 | GG 1 | | $PtO_2 \cdot xH_2O$ | | inserted | — | 15.7 | | |
| | GG 2 | Pt | | 9.28 | inserted | | 16.0 | 1455 | 95.8 |
| 8 | GG 1 | | | | inserted | — | 17.7 | | |
| | GG 2 | Pd | PdO | 9.01 | inserted | | 17.8 | 1445 | 95.5 |
| 9 | GG 2 | | | | inserted | | 17.1 | | |
| | steel 1.1740 | — | — | — | | — | | 1450 | 95.8 |
| | | | | | inserted | | 23.5 | | |
| 10 | GG 2 | | $PtO_2 \cdot xH_2O$ | | inserted | | 17.0 | | |
| | steel 1.1740 | Pt | | 7.87 | | | | 1445 | 95.8 |
| | | | | | inserted | | 23.3 | | |
| 11 | GG 2 | — | — | — | inserted | — | 18.4 | | |
| | GG 3 | | | | inserted | | 32.1 | 1450 | 95.5 |
| 12 | GG 2 | | $PtO_2 \cdot xH_2O$ | | inserted | — | 17.8 | | |
| | GG 3 | Pt | | 8.99 | inserted | | 28.5 | 1455 | 95.5 |
| 13 | GG 2 | — | — | — | inserted | — | 29.8 | | |
| | GG 3 | Pt | wire | 2118.6 | suspended | + | 27.8 | 1445 | 95.8 |
| 14 | GG 1 | — | — | — | inserted | — | 16.8 | | |
| | GG 2 | | | | inserted | | 16.3 | 1445 | 95.8 |
| 15 | GG 2 | Au | wire | 1904.5 | inserted | + | 18.2 | 1450 | 95.8[1] |

[1] with 10 g of starch per kg of concentrated analytically pure $H_2SO_4$. As starch there was used a soluble analytically pure starch $(C_6H_{10}O_5)_n$. Carbon content of the concentrated sulfuric acid at the end of the test: 0.024%.

| Test No. | Distillation of water during the test: $H_2SO_4$ content distillate % | $H_2SO_4$ content in the corrosion mixture at the end of test % | amount of distillate ml | Rate of corrosion mg / $cm^2 \cdot day$ | Precious metal content of conc. $H_2SO_4$ of the corrosion mixture parts per million |
|---|---|---|---|---|---|
| 1 | — | — | — | 195.1 | |
| | | | | 130.0 | |
| 2 | — | — | — | 8.2 | <0.05 |
| 3 | — | — | — | 9.0 | |
| 4 | — | — | — | 27.2 | |
| | | | | 8.6 | |
| 5 | — | — | — | 105.7 | |
| | | | | 57.7 | 0.1 |
| 6 | — | — | — | 33.5 | |
| | | | | 23.5 | 0.3 |
| 7 | — | — | — | 9.2 | |
| | | | | 8.7 | |
| 8 | — | — | — | 42.9 | |
| | | | | 56.3 | 7.8 |
| 9 | 17.3 | 98.0 | 25 | 67.1 | |
| | | | | 20.0 | |
| 10 | 21.8 | 98.6 | 33 | 3.9 | |
| | | | | 449.5 | 2.4 |
| 11 | 10.9 | 98.2 | 42 | 89.7 | |
| | | | | 441.0 | |
| 12 | 14.8 | 98.3 | 30 | 4.1 | 2.4 |
| | | | | 6.2 | |
| 13 | not determ. | not determ. | 28 | 31.6 | |
| | | | | 4.6 | |
| 14 | 16.8 | 97.4 | 30 | 109.3 | |
| | | | | 78.0 | |
| 15 | 23.4 | 98.1 | 45 | 5.5 | 0.09 |

TABLE II

| Type of gray cast iron No. | GG 1 | GG 2 | GG 3 |
|---|---|---|---|
| Chemical composition | | | |
| % C | 3.3 | 3.3 | 3.53 |
| % Si | 2.4 | 2.3 | 2.37 |
| % P | 0.63 | 0.61 | 0.030 |
| % S | 0.15 | 0.14 | 0.005 |
| % Mn | 0.52 | 0.47 | 0.22 |
| % Cr | 0.068 | 0.075 | 0.046 |
| % Ni | 0.043 | 0.032 | 0.046 |
| % Cu | 0.099 | 0.056 | 0.058 |

TABLE II-continued

| | | | |
|---|---|---|---|
| % Al | <0.03 | <0.03 | 0.07 |
| % Ti | not determ. | 0.048 | not determ. |
| % Mg | not determ. | not determ. | 0.040 |
| Type and distribution of graphite acc. to ASTM | lamellar A 4 | lamellar D 7 | modular graphite |
| fundamental texture | largely pearlitic, some ferrite (spots) | largely pearlitic, some ferrite | largely ferritic, some pearlitic islands |

Steel 1.1740 = steel C 60 W 3; guide analysis C 0.60 %; Si 0.25-0.50 %, Mn 0.60-0.80 %; P max. 0.035 %; S max. 0.035 %; measured hardness (HV 10); 221; texture: pearlitic with about 15% of ferrite.

The following values were determined analytically:
C = 0.545%
Si = 0.22%
We claim:

1. A method for protecting gray cast iron from corrosion by boiling concentrated sulfuric acid, which comprises contacting the iron with the boiling concentrated sulfuric acid and an amount of a precious metal selected from the group consisting of gold and metals of the platinum group or a compound thereof which is sufficient to effect an inhibition of the corrosion of the iron by the sulfuric acid.

2. The method as defined in claim 1, wherein the precious metal or a compound thereof is incorporated into the gray cast iron.

3. The method as defined in claim 1, wherein the precious metal is contacted with the surface of the gray cast iron.

4. The method as defined in claim 1, wherein the compound of the precious metal is an oxide, halide or complex metal acid.

* * * * *